US007111558B2

(12) United States Patent
Brede et al.

(10) Patent No.: US 7,111,558 B2
(45) Date of Patent: Sep. 26, 2006

(54) PYROTECHNIC DETONATOR WITH AN IGNITER SUPPORT OF PLASTIC WITH AN INTEGRATED METAL INSERT

(75) Inventors: Uwe Brede, Furth (DE); Eduard Berenz, Furth (DE); Anton Bretfeld, Furth (DE); Harald Frank, Furth (DE); Jurgen Knauss, Obermichelbach (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/354,937

(22) Filed: Jan. 30, 2003

(65) Prior Publication Data

US 2003/0183110 A1 Oct. 2, 2003

(51) Int. Cl.
*B60R 21/26* (2006.01)
*F42B 3/10* (2006.01)
*F42B 3/18* (2006.01)

(52) U.S. Cl. ..... 102/202.9; 102/202.1; 102/202.14; 280/741

(58) Field of Classification Search ..... 102/202.14, 102/202.5, 202.7, 202.9, 202.1, 202.2, 200, 102/202; 280/741
See application file for complete search history.

(56) References Cited

U.S. PATENT DOCUMENTS 3,650,212 A * 3/1972 Bauer ..... 102/310
3,906,858 A * 9/1975 Craig et al. ..... 102/202.9
3,971,320 A * 7/1976 Lee ..... 102/202.9
6,073,963 A * 6/2000 Hamilton et al. ..... 280/741
6,341,562 B1 * 1/2002 Brisighella ..... 102/202.14
6,644,198 B1 * 11/2003 Avetisian et al. ..... 102/202.14
6,763,764 B1 * 7/2004 Avetisian et al. ..... 102/202.14
6,820,556 B1 * 11/2004 Oda ..... 102/202.7
6,823,796 B1 * 11/2004 Amano ..... 102/202.14

FOREIGN PATENT DOCUMENTS

EP 1227016 A1 * 7/2002

OTHER PUBLICATIONS

US 6,584,904, 07/2003, Avetisian et al. (withdrawn)*

* cited by examiner

*Primary Examiner*—Teri Pham Luu
*Assistant Examiner*—James S. Bergin
(74) *Attorney, Agent, or Firm*—Scott A. McBain

(57) ABSTRACT

The invention relates to a pyrotechnic detonator with an igniter support of plastic, which bears an ignition element. A cylindrical metal housing is fastened to the igniter support, into which the ignition reaches. A booster charge is arranged in the metal housing. To improve seal tightness and lower the manufacturing costs, for mechanical support a metal insert is integrated into the igniter support, the metal insert being encased by the plastic of the igniter support.

11 Claims, 5 Drawing Sheets

PYROTECHNIC DETONATOR WITH AN IGNITER SUPPORT OF PLASTIC WITH AN INTEGRATED METAL INSERT

FIELD OF THE INVENTION

The invention relates to a pyrotechnic detonator with an igniter support of plastic.

BACKGROUND AND SUMMARY OF THE INVENTION

DE-A1-199 60 642, which forms the genus, describes a pyrotechnic detonator with an igniter support of plastic. An igniter element is integrated into the igniter support, and its active part protrudes from the igniter support and reaches into a metal case which is fastened to the detonator holder. A booster charge is contained in the metal case.

The igniter support of plastic serves the purpose of fixing the ignition element in the metal case in a mechanically secure manner. In addition, it must assure that, when the detonator operates, no gas can escape between the plastic igniter support/ignition element and/or the plastic detonator holder/metal case.

On account of the need for mechanical strength in the operation of the detonator, in conjunction with the complex form in the contacting area of the ignition element, the igniter support has heretofore been made by machining as a combination turning and milling part. This method of manufacture is very cost-intensive.

The invention addresses the problem of improving a pyrotechnic detonator with respect to its sealing and its manufacturing costs.

This problem is solved according to the invention by integrating a metal insert in the igniter support for mechanical support, the metal insert being embedded in the plastic of the igniter support.

In preferred embodiment the metal insert is a stamped part or is made by bending.

Advantageously the plastic of the igniter support is doped with mica.

The ignition element is partially or entirely encased in plastic.

It is appropriate to wet the ignition element with a sealing composition before it is encased in plastic.

In certain areas an elastic synthetic material can be used as plastic for the igniter support.

In a preferred embodiment the metal insert is bonded with the ignition element. Thus only a portion has to be encased in the plastic.

Advantageously, the metal insert is cup-shaped, the margin of the metal insert being beaded or folded over, and is brought out from the igniter support.

For better bonding with the plastic, holes are advantageously provided in the metal insert.

The invention is characterized in a preferred embodiment by the fact that, instead of complicated machining, a stamped and bent piece is used which is then encased as an insert.

This manner of manufacture is very economical, since both the insert and the subsequent injection molding process can be performed at low cost. Both manufacturing methods can be practiced with multiple tools, resulting in an additional cost reduction.

In this arrangement the metal insert or stamped or bent piece provide the mechanical support which can be made with equal strength and less wall thickness due to their stiffness than a turned or milled part. Thus a saving of weight can additionally be achieved.

The plastic in the igniter support assures the seal between the igniter support/ignition element and/or igniter support/metal case. The necessary complex shape in the contact area of the ignition element can likewise be achieved with the plastic by the injection molding process.

In practice, it has developed in the conventional igniter supports that, due to stray conductive impurities, e.g., metal chips, an unwanted electrical connection can develop in the contact region between the ignition element and the igniter support which can result in failure of the detonator to operate. In the case of a plastic igniter support such electrical connections cannot develop since it insulates in the contact area.

To increase safety against electrostatic discharges (ESD) between the ignition element and the metal casing, the plastic of the igniter support can be doped with mica. This results in a high-resistance plastic that develops low resistance at high voltage, and bleeds off the ESD discharges so that no unintentional firing takes place.

Additional features of the invention are shown by the figures, which are described below.

DETAILED DESCRIPTION

Figure 1:
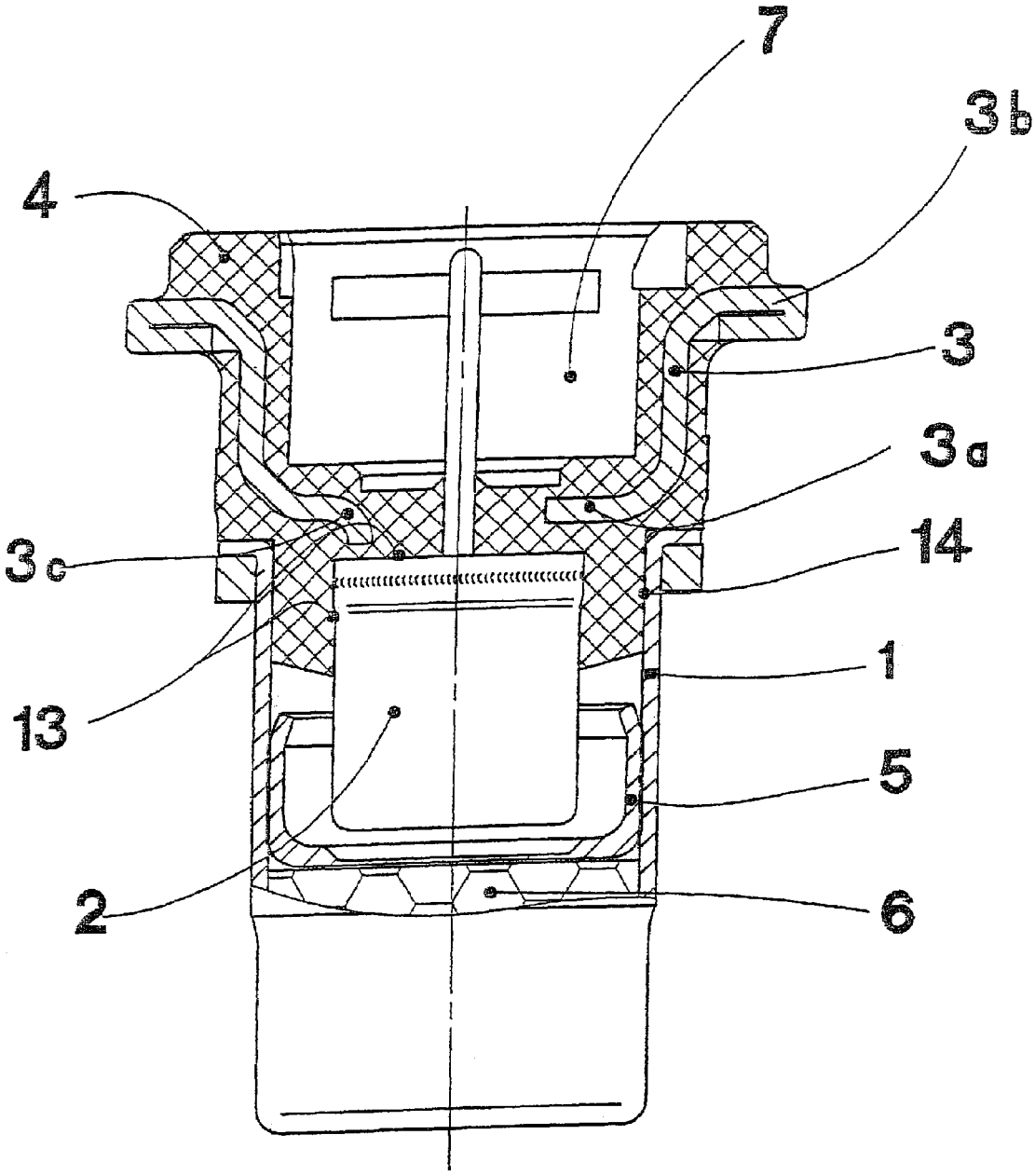
FIG. 1 depicts a typical detonator into which an igniter made of plastics can be inserted.

In FIG. 1 a typical detonator is shown, into which the igniter support 4 made of plastic can be inserted.

As it can be seen, the ignition element 2 is partially encased in the igniter support 4 and the metal insert 3 is integrated in it. The igniter support 4, in turn, is connected to an envelope 1 which in its lower portion contains a sealing cup 5 which protects the booster charge 6 in its installed state against moisture and thus assures the operation of the detonator throughout the time of its use.

To improve the seal in area 13 between the ignition element 2 and the plastic of the igniter support 4 and area 14 between the envelope 1 and the plastic of the igniter support 4 a vapor block can be installed. This can be achieved, for example, by wetting the ignition element 2 with an appropriate sealant which becomes effective after the injection molding, because of the heat it introduces and/or the shrinkage of the plastic onto the ignition element 2. Another way of obtaining a vapor block is to use an elastic plastic in the areas 13 and 14. This can be done, for example, by an injection process (2-component injection molding).

With this arrangement, the ignition element 2 is securely fixed in the igniter support 4 and thus in the pyrotechnic detonator over its entire life, even despite all environmental influences, and no moisture can penetrate into the detonator.

To assure that no unintentional ignition occurs due to electrostatic discharges (ESD) between the ignition element 2 and the case 1, the plastic of the igniter support 4 can be doped with mica, as described above.

In the operation, the reaction of the pyrotechnic igniter in the ignition element 2 of the detonator and the booster charge 6 that follows produces briefly a high gas pressure which acts as an axial force on the ignition element 2 and the igniter support 4, which forces the ignition element 2 sealingly into the igniter support 4.

To prevent the ignition element 2 from being forced into the igniter support 4, a support must be provided in the holder, so that the gas may undesirably escape partially or entirely between the ignition element 2 and igniter support 4. In an extreme case where the ignition element 2 is forced through the igniter support 4, support must be provided in the holder.

This support is achieved by providing metal insert 3 which is an integral part of the igniter support 4 to securely support the ignition element 2 in the area 3*a*, 3*b*. Due to the shape and method of producing the metal insert 3 by bending, a great stiffness is created which reliably assures such support. Thus it is assured that no deformation of the metal insert 3 will take place even under the greatest pressure.

To fix the igniter support 4 in the primary device, the metal insert 3 is designed so that it will project in area 3*b* from the igniter support 4 and can be fastened in the primary device.

Figure 2:
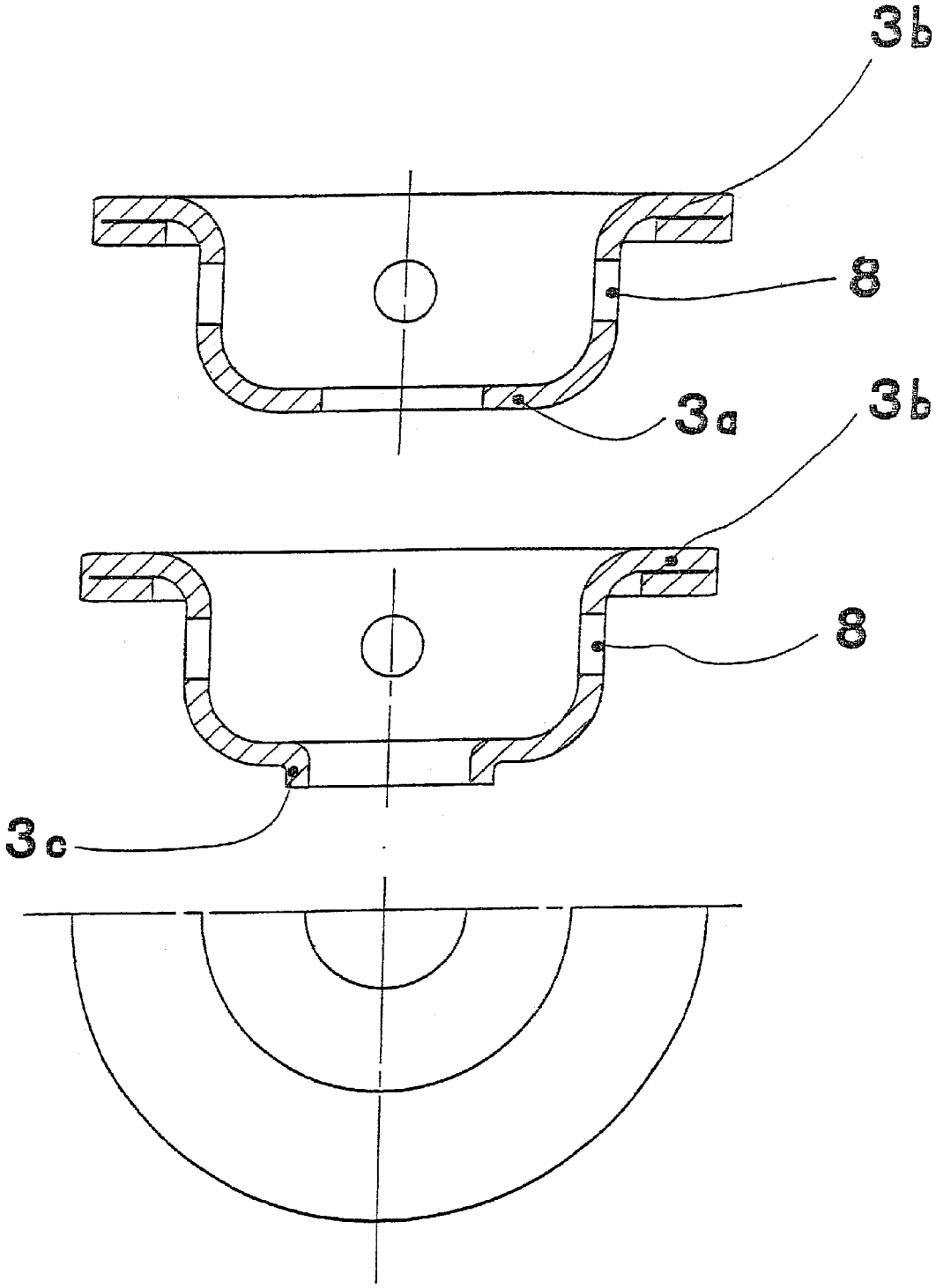
FIG. 2 shows a preferred form of metal insert according to the invention.

In FIG. 2 a possible form of the metal insert 3 is drawn. As it can be seen, this part is preferably made by punching it out and then finishing it as shown.

The metal part can have openings 8, for example, so as to improve the interlocking of the metal insert 3 with the plastic.

In the outer area 3*b* the metal piece 3 is folded over to provide additional strength.

If necessary, the metal insert 3 can be additionally shaped in the inner area 3*a* to increase rigidity, as represented at 3*c*.

Figure 3:
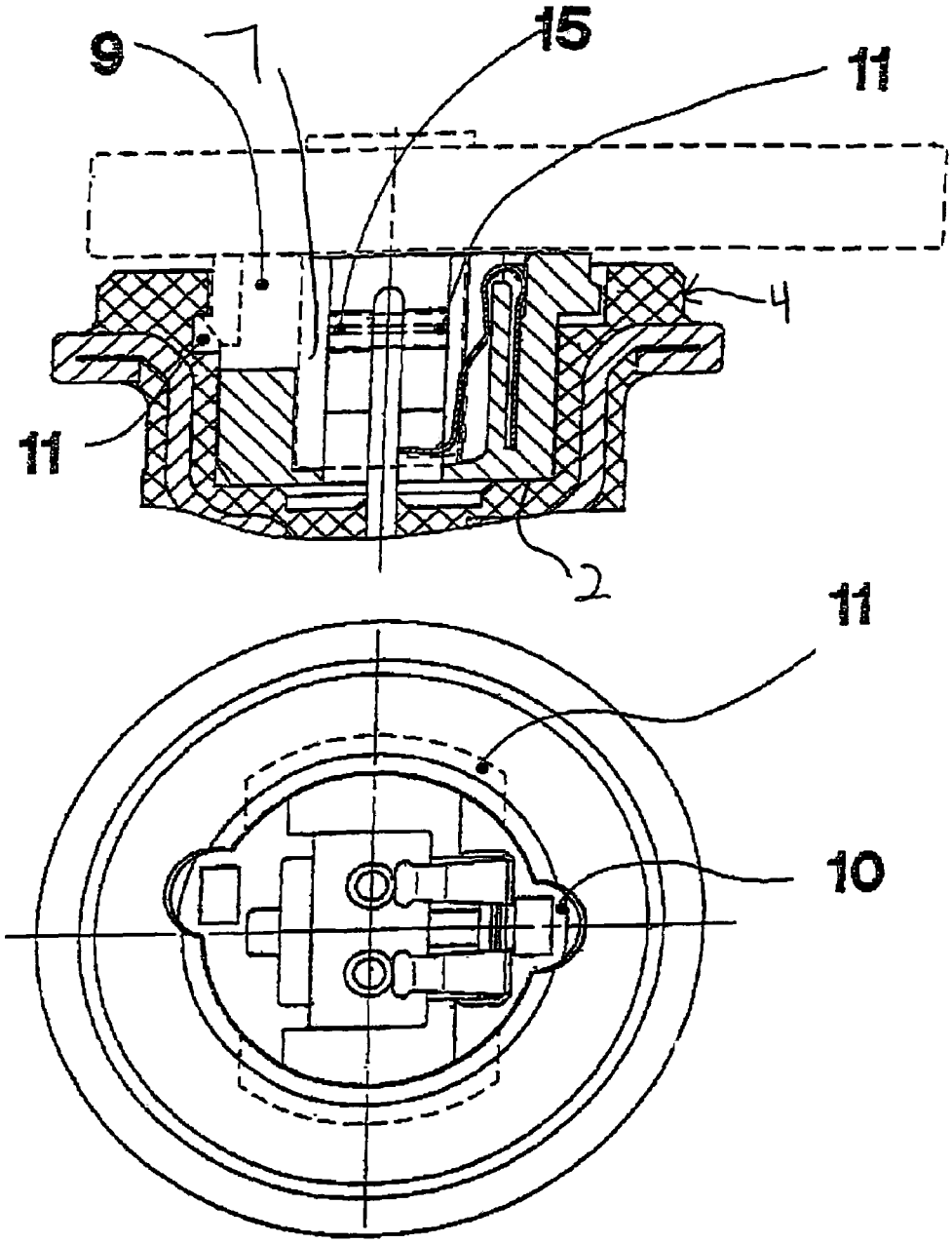
FIG. 3 shows how the ignition element is contacted in area 7, showing a contact safety device.

In FIG. 3 is shown how the ignition element 2 is contacted in area 7. As it can be seen, a contact safety device 9 is necessary for the contacting and is held in position by corresponding recesses 10.

Additionally, recesses 11 are necessary in the igniter support 4 in order to permit the plug to be locked at 15 on the plug (plug is shown in broken lines and the locking is shown turned 90°) in the igniter support 4.

Figure 4:
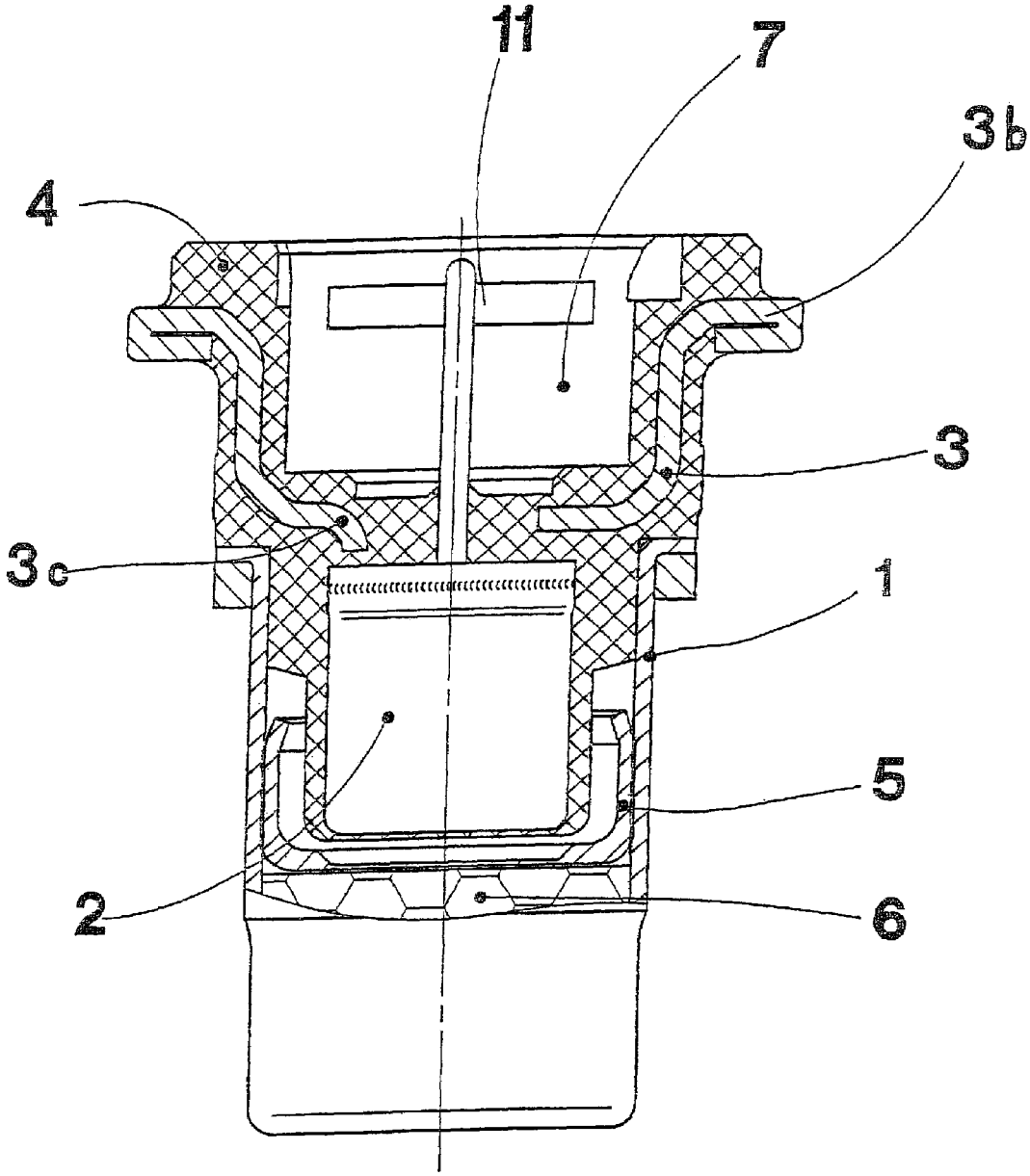
FIG. 4 shows an alternative embodiment of an igniter support.

In FIG. 4 there is shown another possible embodiment of an igniter support 4. In this variant the entire ignition element 2 is embedded.

This has the advantage over FIG. 1 that complete electrical insulation is achieved between ignition element 2 and case 1. Thus the electrostatic strength of the detonator 2 and casing 1 is increased. Additional improvement is achieved by doping the plastic of the igniter support with mica, as is described in the beginning.

Figure 5:
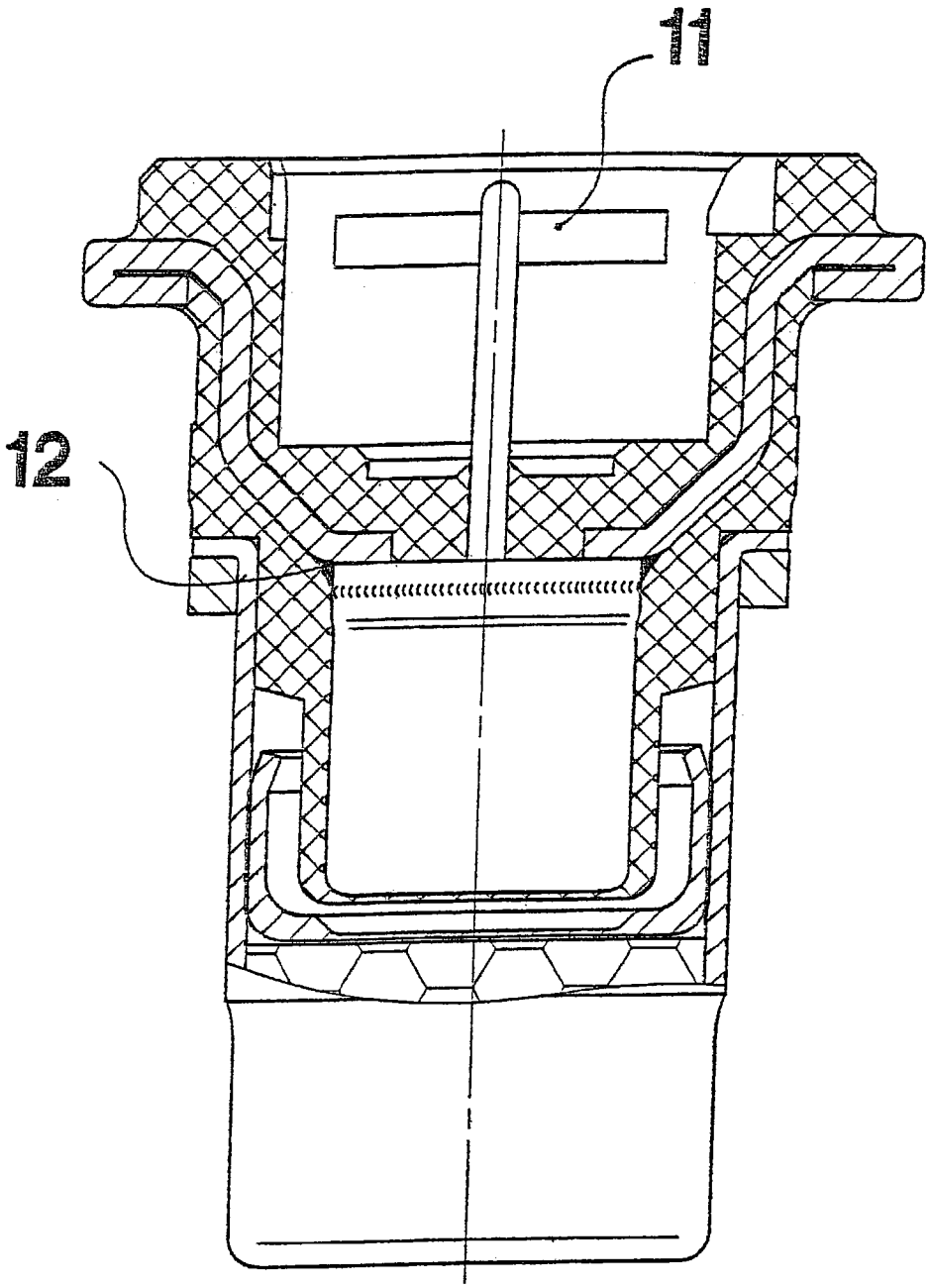
FIG. 5 shows an alternative arrangement of the metal insert in the igniter support.

In FIG. 5 is shown another technical possibility for arranging a metal insert 3 in the igniter support 4. The metal insert 3 is bonded to the ignition element 2; this can be done by welding, for example. Thus an additional mechanical fixation of the two parts is achieved.

Another advantage is that the injection molding process can be performed more simply, since only one part (instead of two parts) needs to be inserted.

"Booster charge 6" means an intensifying charge and the case 1 is a housing.

The invention claimed is:

1. A pyrotechnic detonator comprising:
an ignition element having an area to be supported;
a metal insert having an inner portion and an outer portion;
a plastic support that at least partially encases said ignition element;
a cylindrical metal case fastened to said plastic support into which the ignition element reaches; and
a booster charge arranged in said metal case,
wherein said inner portion of said metal insert is encased and integrated with said plastic support,
openings are arranged in said inner portion of said metal insert and said openings are filled by said plastic support, and
said outer portion of said metal insert projects from the plastic support and is folded over itself.

2. A detonator according to claim 1, wherein the metal insert is made by stamping or bending.

3. A detonator according to claim 1, wherein said plastic support is doped with mica.

4. A detonator according to claim 1, further comprising a sealing composition between said ignition element and said plastic support.

5. A detonator according to claim 1, wherein said inner portion of said metal insert is bonded directly to the ignition element.

6. A detonator according to claim 1, wherein said metal insert is cup-shaped.

7. A pyrotechnic detonator comprising:
an ignition element having a first end, an opposing second end, and a central axis extending there between;
a plastic support encasing at least said first end of said ignition element;
a cylindrical metal case fastened to said plastic support into which said second end of said ignition element reaches;
a booster charge arranged in said metal case adjacent said second end of said ignition element; and
a metal insert having a first end portion adjacent said first end of said ignition element, a second end portion, and a middle portion there between,
wherein said first end portion is bent relative to said middle portion toward the central axis, and said middle portion and said first end portion are encased and integrated with said plastic support,
wherein openings are arranged in said middle portion of said metal insert and said openings are filled by said plastic support, and
wherein said second end portion is bent relative to said middle portion away from the central axis and projecting out from the plastic support.

8. A detonator according to claim 7, wherein said plastic support is doped with mica.

9. A detonator according to claim 7, further comprising a sealing composition between said ignition element and said plastic support.

10. A detonator according to claim 7, wherein said first end portion of said metal insert is bonded directly to the ignition element.

11. The detonator of claim 7, wherein said second end portion is folded over itself.

* * * * *